US008601736B2

(12) United States Patent
Andersson

(10) Patent No.: US 8,601,736 B2
(45) Date of Patent: Dec. 10, 2013

(54) METHOD AND A DEVICE FOR STABILIZING AIMING DIRECTION FOR RIFLES AND HANDGUNS AND FIRE ARM

(76) Inventor: Tommy Andersson, Stockholm (SE)

( * ) Notice: Subject to any disclaimer, the term of this patent is extended or adjusted under 35 U.S.C. 154(b) by 110 days.

(21) Appl. No.: 13/127,706

(22) PCT Filed: Nov. 4, 2009

(86) PCT No.: PCT/SE2009/051249

§ 371 (c)(1),
(2), (4) Date: May 20, 2011

(87) PCT Pub. No.: WO2010/053436

PCT Pub. Date: May 14, 2010

(65) Prior Publication Data

US 2012/0030984 A1 Feb. 9, 2012

(30) Foreign Application Priority Data

Nov. 4, 2008 (SE) ..... 0802342

(51) Int. Cl.
*F41C 23/14* (2006.01)

(52) U.S. Cl.
USPC ..... 42/75.03

(58) Field of Classification Search
USPC ..... 42/75.03, 75.01, 75.04, 1.06, 75.02; 89/37.03, 37.04, 41.02, 41.04, 41.17, 89/41.16, 203, 41.09, 41.06, 202, 201; 235/404, 405, 407
See application file for complete search history.

(56) References Cited

U.S. PATENT DOCUMENTS 5,413,028 A 5/1995 Ng et al.
5,834,677 A 11/1998 Muller
5,974,940 A 11/1999 Madni et al.
6,497,171 B2 * 12/2002 Gerber et al. ..... 89/41.09
7,597,041 B2 * 10/2009 Gerstadt et al. ..... 89/203
2006/0194173 A1 8/2006 Lavigna et al.

FOREIGN PATENT DOCUMENTS

DE 3643197 6/1988
EP 0898144 2/1999

OTHER PUBLICATIONS

International Search Report for International Application No. PCT/SE2009/051249 dated Feb. 12, 2010 by Swedish Patent Office.
Written Opinion of International Searching Authority for Application No. PCT/SE2009/051249 mailed on Feb. 12, 2010 in 6 pages.

(Continued)

*Primary Examiner* — Michael Carone
*Assistant Examiner* — Reginald Tillman, Jr.
(74) *Attorney, Agent, or Firm* — Knobbe Martens Olson & Bear, LLP

(57) ABSTRACT

A method for stabilizing a weapon, eg a rifle or a handgun, barrel movements when aiming by attenuating the influence of, primarily, unintentional barrel movements on the barrel orientation. The method is especially characterized in the steps of providing a hinge (3) between the barrel front part (1), which comprises the barrel (1'), and the weapon rear part (2), which comprises the weapon butt end (2'), for mutual movability between said parts;

continuously detecting the barrel longitudinal direction movement in at least two planes; and controlling at least one angle between the butt end and the barrel longitudinal direction orientation, respectively, by means of a control system (4*h*, 4*v*, 5*h*, 5*v*, 6*h*,6*v*) so that changes in the barrel orientation are counteracted.

The invention also relates to a device and a fire arm.

36 Claims, 7 Drawing Sheets

(56) References Cited

OTHER PUBLICATIONS

State Intellectual Property Office of P.R.C., Search Report in Application No. 200980143992.0 mailed on Mar. 1, 2013 in 2 pages.

State Intellectual Property Office of P.R.C., Notification of the First Office Action in Application No. 200980143992.0 mailed on Mar. 12, 2013 in 8 pages.

* cited by examiner

METHOD AND A DEVICE FOR STABILIZING AIMING DIRECTION FOR RIFLES AND HANDGUNS AND FIRE ARM

BACKGROUND

1. Technical Field

Embodiments of the present invention relate to a method according to the introductory portion of the attached claim 1.

Embodiments of the invention also relate to a device according to the introductory portion of the attached claim 18.

Embodiments of the present invention further relate to a firearm according to claim 35.

2. Prior Art

Technique of the above referenced kind is previously known.

The accuracy of fire in rifle shooting and in handgun shooting is limited inter alia of the quality of the weapon and ammunition and of the kind of the sights used. One reason for the point of impact to vary from shot to shot may eg be that the bullet weight and gun-powder load varies from cartridge to cartridge. Even if the weapon is fired in the same direction and under the same further conditions during a series of shots, the point of impact of the shots will get a certain spread which is caused by the quality of the materials used. For modern weapons, however, the spread caused by shortcomings of the weapon precision or the quality of the ammunition by free hand shooting, i.e. without any external support for the weapon, is small compared to the spread caused by the marksman himself by not being able to hold the weapon still enough during the aiming and for this reason will have it difficult to make a firing in the direction desired. In order to hit as good as possible the marksman must try to hold the weapon still in the direction towards the target and make the firing at a moment when the aiming direction, during the unavoidable and partly random movement around the target, coincides with the direction towards the target. The better the marksman can control the movement of the aiming direction up to a desired position for firing and the slower this movement is, the easier it is to make a good firing and get a good hit. What, inter alia, characterizes the unintentional barrel movements during the aiming is that these movements are comparatively fast and relatively small compared to the intentional changes of the aiming direction, which are bigger and slower.

In U.S. Pat. No. 5,834,677 a rifle with a built in servo system stabilizing the aiming direction and thereby improving the accuracy of fire is described. The barrel (the fire tube) is in this case suspended inside an outer pipe in which the barrel can move. The pipe around the barrel increases the total weight and moves the point of gravity forward which is a drawback since more power is then needed to hold the rifle horizontally. Further, the motors which shall affect the direction of the barrel are mounted in the forward end of the barrel which still further moves the point of gravity forward. The point of gravity in a conventional rifle is normally located to a point about right between the two positions where the right and the left hand, respectively, holds the rifle, i.e. about at the trigger. According to the present invention no external mechanic s around the barrel is needed to control its direction. Therefore the weight in front of the rifle point of gravity does not increase for this reason. Thus, the present invention may be applied to weapons with a relatively long barrel without impairing the so called balance, or, in other words, that the point of gravity is moved forward. According to the present invention a major part of the elements comprised by the servo system, i.e. motors, electronics and mechanics, are located at the weapon rear end, so that the weapon point of gravity is not moved forward by the additional elements.

A drawback with the design according to the U.S. Pat. No. 5,834,677 is that the sight, to be able to show the actual direction of shot, must be mounted on the barrel surrounded by the pipe. This complicates the design. The mounting of the sight according to the present patent is done in the same way as on conventional weapons. Therefore, according to the present invention the design becomes less complicated.

In U.S. Pat. No. 5,974,940 a system is described in which the direction of the barrel is stabilized by means of two linear motors. The weight and the positioning of these motors move the point of gravity forward and makes the weapon heavy in the front. In the same U.S. Pat. No. 5,974,940, the stabilizing servo system is activated by the trigger having to be pulled to a first position which activates the servo system. Firing is then done by the trigger being pulled further. The method may imply a risk that the marksman by mistake fires a shot instead of activating the servo system. Another drawback with this method of activating the servo system is that it reasonably needs considerable training to be applicable in an efficient and safe way. Normally, the trigger is not used for anything else but firing a shot. According to the present invention no change of the function of the trigger is needed since the activation of the servo system is done by the marksman when aiming presses a press plate against the shoulder and thereby closes a circuit which activates the servo system. The marksman does therefore not perform any special operation to start the servo system in addition to the ones performed at normal shooting.

An object of the present invention is, inter alia, to solve the problems associated with the prior art technique.

SUMMARY OF THE INVENTION

This object is obtained by means of the disclosed embodiments, including a method, a device and a fire arm having the features according to the attached claims 1, 18 and 35, respectively.

Further advantages are obtained by what is stated in the respective dependent claims.

The present invention regards a method and a device designed in such a way that movements of the barrel at aiming are attenuated by means of a servo system stabilizing the orientation of the barrel built-in in the weapon. In the servo system measuring means are included continuously measuring the rotation speed vertically and horizontally of the barrel and motors able to change the direction of the barrel in relation to the butt end so that the orientation of the barrel is stabilized whereby the aiming of the weapon in the desired direction is simplified and the accuracy of fire increases. By means of the stabilization the unintentional barrel movements, appearing at the aiming when the marksman, without having any physical support for the weapon, tries to control the sight direction towards the target, are counteracted. The technique may be applied for all kinds of rifles and also for handguns, like pistols and revolvers.

An important feature of the invention described here is that it is well adapted to be applied to present weapons, for which the patents mentioned are hardly suitable.

The invention comprises a rifle or a small arm designed in such a way that the shot at aiming is supported by a stabilizing servo system which attenuates the fast and unintentional barrel movements, whereby the marksman more easily can control the aiming direction towards a desired hit position and, by the calmer movement of the barrel and aiming direction also get a longer time to choose the right firing moment.

In a rifle or a handgun designed according to the invention the weapon is divided into two mutually movable parts, a front part, in which the barrel is included, and the butt end. The two parts are movable in relation to each other in a common point where they are connected by a biaxial bearing a hinge, which provides movability horizontally and vertically. The bearing is placed where the butt end adjoins the front part. The angle between the orientation of the butt end and the barrel is regulated by a servo system controlling the angle between the butt end and the barrel so that fast changes in the barrel orientation are counteracted and attenuated, which makes it easier to aim and to fire a shot in a desired direction. The turning torque changing the barrel orientation is accomplished by applying a turning torque in the opposite direction by the servo system. If eg the barrel shall be turned clockwise in order to compensate an externally, i.e. by the marksman, imposed movement, the butt end is turned anticlockwise. The moment of inertia of the butt end causes a turning torque to act on the barrel the direction of which is then changed. If the butt end at the rear end rests against a more or less solid object, in rifle shooting normally the shoulder of the marksman, the turning torque increases. In the case of shooting with handguns the conditions are principally similar but the shorter butt end and the fact that the weapon does not have contact with any big mass at the rear end, as is the case in rifle shooting (the shoulder of the marksman), means that the moment of inertia of the butt end becomes of greater importance. In the embodiment shown as an example is shown how the mass of the butt end may be arranged so that the heavier objects are placed farther away from and behind the bearing in order to give the butt end a moment of inertia great enough. In addition attenuating unintentional fast movements of the barrel the stabilizing servo system acts so that the movement of the barrel upwards, which arises at the recoil after a shot is also attenuated, so that one, with a weapon designed according the present patent and especially a semiautomatic rifle, is able to fire a well directed second shot faster.

BRIEF DESCRIPTION OF THE DRAWINGS

A better understanding of the present invention will be had when studying the following detailed description read in conjunction with the attached drawings, wherein like details are designated like in the different views and wherein.

DETAILED DESCRIPTION OF PREFERRED EMBODIMENTS

Figure 1A:
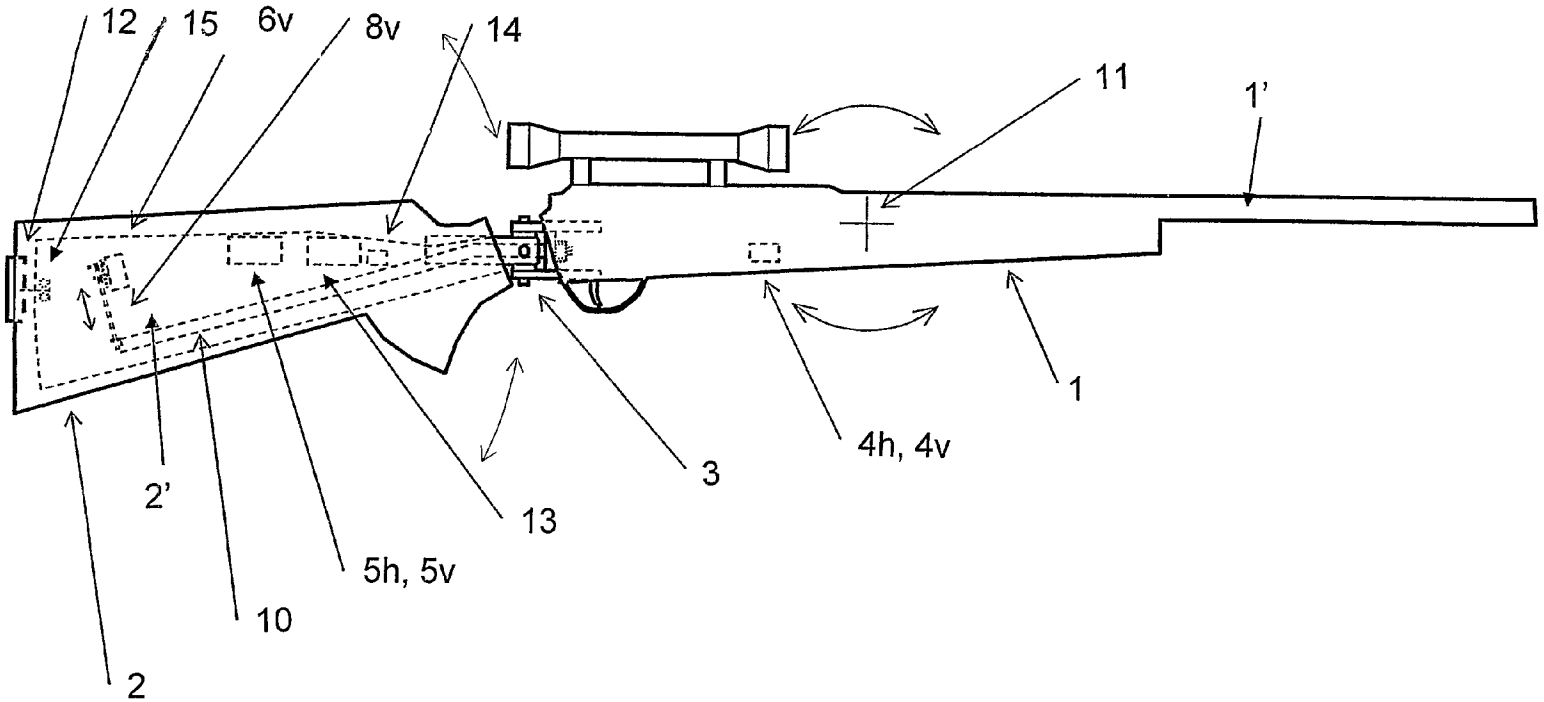
FIG. 1*a* shows a rifle with a stabilized aiming direction seen from the right side.

FIG. 1*a* The figure shows a rifle with a stabilized aiming direction seen from the right side. Certain important functional elements, which are hidden, are shown in broken lines. Certain hidden elements are not shown in the drawing. Between the two mutually movable parts, front part 1 and the butt end 2, parts of a hinge 3, a bearing 3, which gives the two parts movability horizontally and vertically may be seen. The gap between the butt end and the front part have for clarity reasons been made bigger than what is needed to give the desired movability. Through the bearing 3 the rod 10 applied in the front part protrudes backwards in the butt end. At the end of the rod the arm 8*v* is coupled so that it can transmit a rotational movement of the motor 6*v* to a mainly linear and vertical movement of the rod 10 end, whereby the angle between the butt end and the barrel can be changed. Parts which give movement horizontally have been deleted in the figure to increase the clarity. In the rear end of the butt end the protruding press plate 12 may be seen.

From the figure it will be seen that the external design of a rifle according to the patent does not have to differ to any appreciable extent from the design of a conventional rifle for hunt and target shooting and for military and police use.

Figure 1B:
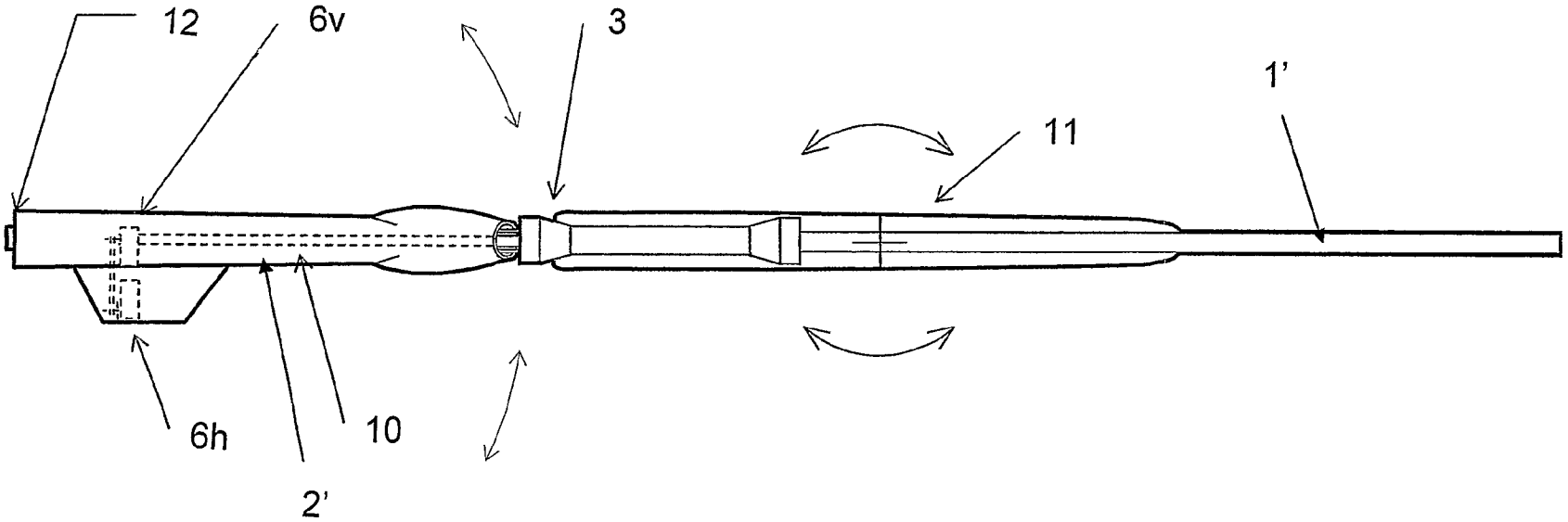
FIG. 1*b* shows a rifle with a stabilized aiming direction seen from above.

FIG. 1*b* The figure shows a rifle with stabilized aiming direction seen from above. From the hidden elements only the rod 10 and the motors 6*h* and 6*v* have been included.

Figure 2:
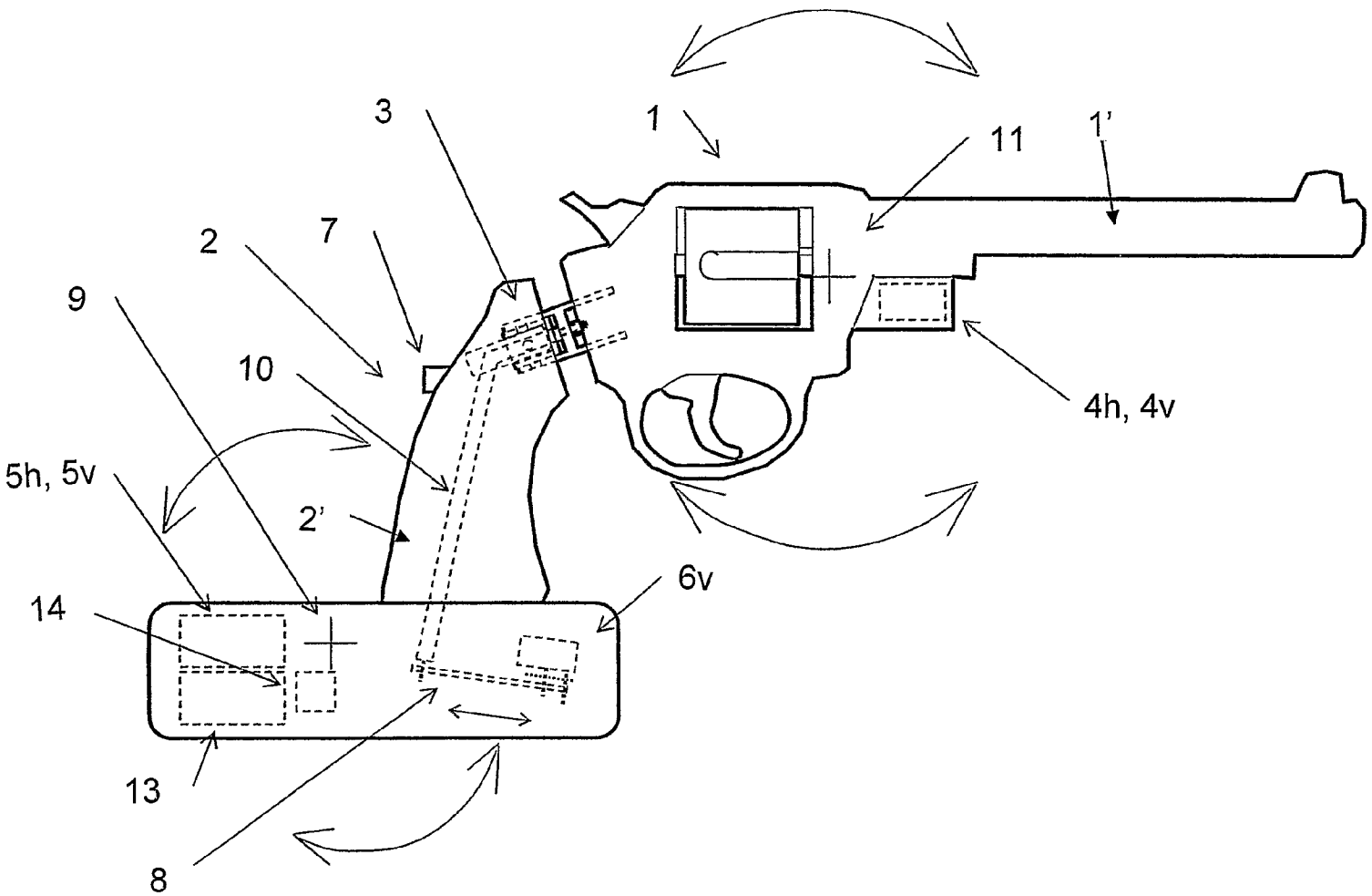
FIG. 2 shows a revolver with a stabilized aiming direction seen from the right side.

FIG. 2 The figure shows a revolver with stabilized aiming direction seen from the right-hand side. For space reasons batteries, electronics, motors and other elements have been located to an apparatus box fixed under the pistol-grip. In order to increase the moment of inertia of the butt end heavy elements have been located far from and behind the bearing 3.

Figure 3A:
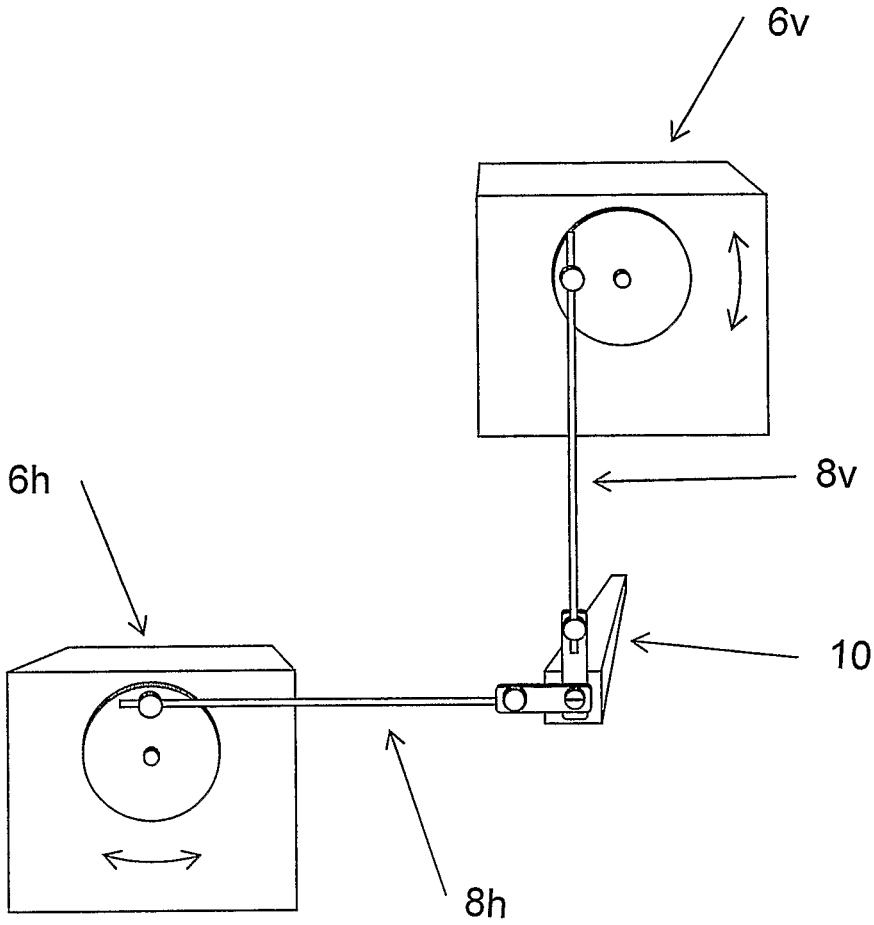
FIG. 3*a* shows an arrangement of motors and rod by use of motors with a rotating movement.

FIG. 3*a* The figure shows the principle of how the mechanics connecting the motors 6*h* and 6*v* with the rod 10 may be arranged. In the example the motors are used with a rotating wheel on the output shaft.

Figure 3B:
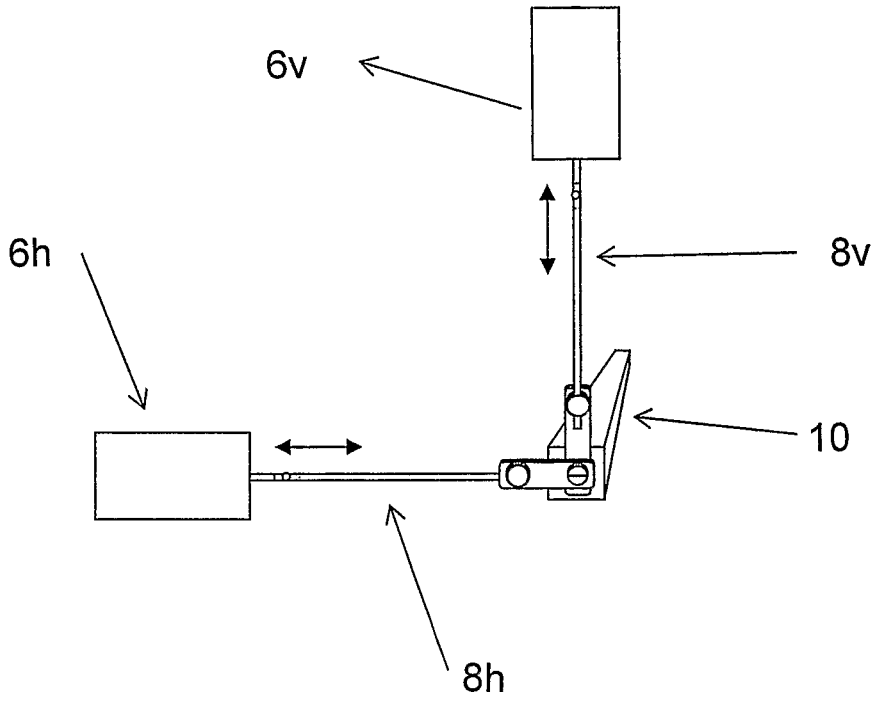
FIG. 3*b* shows an arrangement of motors and rod by use of motors with motors with a linear movement.

FIG. 3*b* The figure shows the principle for how the mechanics connecting the motors 6*h* and 6*v* with the rod 10 may be arranged when motors with a linear movement are used.

Figure 4:
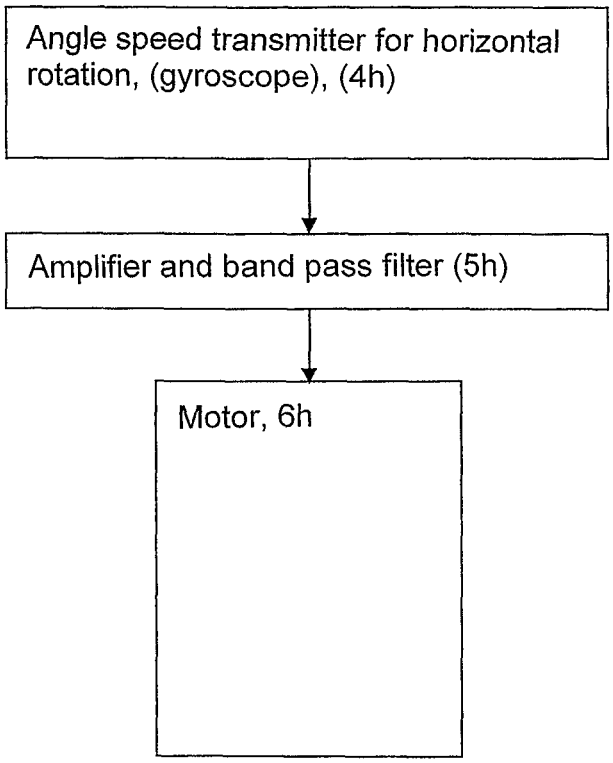
FIG. 4 shows a block diagram over electronic components and motor for the horizontal channel.

FIG. 4 In the figure it is diagrammatically shown how the electronic components and the motors in the horizontal channel are coupled. The components in the vertical channel are coupled in an analogous way.

Figure 5:
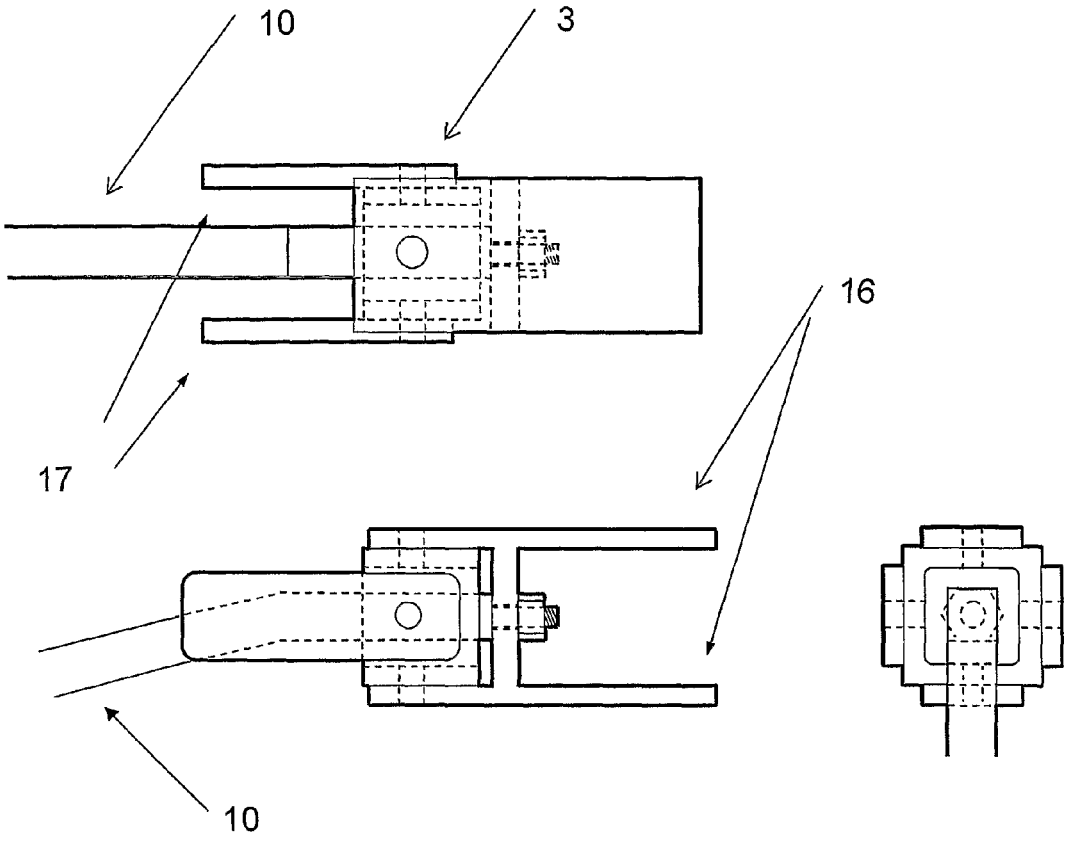
FIG. 5 shows a hinge, a bearing, in the form of a cardan joint and a rod.

FIG. 5 The figure shows the bearing between the barrel and the butt end and the rod 10. The flanges to the right 16 are used to fasten the bearing in the barrel 1 eg with a bolted joint. The flanges to the left 17 are used to fasten the bearing in the butt end in a corresponding way.

In a rifle or a handgun designed according to the invention the weapon is divided into two mutually movable parts, a front part 1 including the barrel and the butt end 2. The two parts 1 and 2 are movable in relation to each other in a common point whereat they are connected by a biaxial bearing 3 suitably designed as a cardan joint. The bearing is located where the butt end connects to the front part. The bearing makes it possible to rotate the butt end around the bearing point in relation to the barrel in two mutually perpendicular planes, vertically and horizontally.

The angle between the orientation of the butt end and the barrel is regulated by a control system, preferably a servo system controlling the angle between the butt end and the barrel so that fast changes in the barrel orientation are attenuated, which makes it easier to aim and to fire shots in a desired direction.

In the control system, the servo system, there are according to a preferred embodiment included:

two angular velocity transmitters, eg gyroscopes, mounted in the weapon front part, which transmitters register the barrel rotational speed in two planes, horizontally and vertically, 4*h* and 4*v*, respectively;

two amplifiers 5*h* and 5*v*, respectively, with band pass filter amplifying and filtering the signal from the gyroscopes;

two electric motors, 6*h* and 6*v*, which are controlled by the amplifiers 5*h* and 5*v* and which, by moving the rear end of the rod 10 in relation to the butt end are able to change the angle between the butt end and the barrel horizontally and vertically. In the figures the motor affecting the rod, and thereby the barrel, direction vertically, is indicated by 6*v*, while the motor changing the barrel orientation horizontally is indicated by 6*h*. The motors may be designed in different ways to provide the desired linear movement. In the design in the FIGS. 1*a*, 1*b*, 2 and 3*a*, rotating motors have been indicated, having a gear lowering the number of revolutions on the output shaft, the rotating motion of which is transformed to a (mainly) reciprocating motion by two arms 8*h* and 8*v*, respectively, being coupled to bearings at the periphery of the wheel mounted on the motor output shaft. An alternative to a rotating motor is a linear motor directly providing a linear motion according to FIG. 3*b*. Irrespective of if the motors have a rotating or linear motion they may be designed as servo motors, i.e. the motors have a built-in automatic control system controlling the output shaft position so that its deflection is proportional to the input signal.

The two motors 6*h* and 6*v* are via arms 8*h* and 8*v* coupled to the rear end of the rod running through the center in the cardan joint 3 and is fixed to the weapon front part 1 where it, suitably, is fastened in the part of the cardan joint being fastened in the weapon front part 1 according to FIG. 5, i.e. the right hand part with flanges directed to the right 16. When the rear end of the rod is moved by the arms 8*h* and 8*v*, respectively, the angle between the barrel 1' and the butt end 2' is changed by the butt end and the barrel rotating in relation to each other in the bearing 3.

The motors 6*h*,6*v* thus constitute drive means for the control system affection of the angle between the two parts 1, 2. Of course, other drive means than electrical motors may be imagined, eg electromagnetic devices or piezoelectric devices.

The function of the servo system is to, by changes in the barrel longitudinal direction orientation, change the angle in the bearing point 3 so that the change in the barrel direction is counteracted. The principal function of a rifle designed according to the invention may be described by the following example. Suppose that the marksman, after having activated the main current switch 14 and in this way started the servo system electronics, makes an aiming, i.e. lifts the weapon and approaches the butt end to the shoulder. When the marksman presses the butt end against the shoulder the current switch 15 is activated, which makes the servo system motors to be activated, whereby the barrel sighting from then on is stabilized. Suppose further that the marksman aims at a target he wants to shoot and that he during the aiming unintentionally lowers the hand holding around the front stock, i.e. the bottom part of the weapon front part 1. When the barrel as a result of this starts to be lowered, a rotation in the rifle starts, i.e. the barrel and the butt end 1, 2 rotate together around the point where the butt end is in contact with shoulder of the shot. When the barrel is lowered the rotation, if we consider the rifle of FIG. 1*a*, to be directed clockwise. The rotation gives rise to a change in the signal from the gyroscope 4*v* measuring the barrel vertical rotational speed. The signal affects, via the amplifier 5*v*, the motor 6*v* changing the angle vertically between the butt end 2 and barrel 1 so that the rear end of the rod 10 is pressed downwards in relation to the butt end rear end, whereby the butt end front and the barrel rear end are affected by a force directed downwards. Since the force pressing the rod 10 downwards is not directed towards the front part center of gravity but towards a point behind the center of gravity (to the left in FIG. 1*a*), this force gives rise to a turning torque acting on the barrel 1, which torque in FIG. 1*a* will have the direction anticlockwise. The barrel rear end is lowered whereby its orientation is changed so that the aiming direction is raised, whereby the unintentional lowering of the aiming direction is decreased or eliminated. In this way the aiming direction (and the shot direction) is returned to a greater or smaller extent, depending on the movement speed and size to the orientation the barrel had before it was lowered by the marksman.

At a commenced rotation in a horizontal direction adjustment of the barrel direction in the horizontal plane takes place by influence of the corresponding elements in the servo system horizontal channel.

In the case of a handgun the function gets principally the same with the exception that the butt end 2 rear end does not lie against the shoulder of the marksman and thereby is not fixed to a (relatively) fixed point. Instead of the butt end 2 rotating around the butt end rear end, it tends to rotate around its mass center, i.e. its center of gravity. If the weight of the part here called the butt end 2 and including the servo system electronics and mechanic is great enough and is located far enough from the bearing 3, the turning torque on the barrel when the servo system operates will be great enough for the barrel to be stabilized by the mass and the moment of inertia of the butt end 2.

What is characterizing for the unintentional barrel movements, i.e. the movements to be attenuated by the servo system, is that they to a greater extent than the intentional movements comprise high frequency components. By a suitable choice of the frequency range within which the servo system operates, the marksman may make intentional adjustments of the barrel orientation without being hindered by the servo system in any other way than observing a certain inertia in the barrel motion, while on the contrary faster changes of the barrel orientation, which usually are unintentional, are counteracted and attenuated to a greater extent.

According to preferred embodiments the signal from the angle speed transmitters is intended to be filtered by a high pass filter in the band pass filters of the amplifiers and then suppress signals having comparatively low frequency and let signals having comparatively high frequency through, so that comparatively slow changes of the barrel orientation are not counteracted, attenuated, to as high a degree as fast, usually unintentional, changes of orientation.

It is preferred to provide high pass filtering with a chosen limiting frequency of the high pass filter for adaption of attenuation of barrel movements to eg the actual weapon and use.

A preferred interval for such limiting frequencies is about 0.5 to about 5 Hz.

The servo system electronics and motors are driven by batteries which are built-in in the weapon 13. In addition to a main switch for switching on and off the voltage for the servo system electronics mounted at a suitable location on the weapon 13, a press plate 12 is included in a rifle and a switch 15 connected to the plate and mounted in the butt end end, which switch activates the servo system motors. The press plate is pushed out to its outer position by a spring and is pushed in when the marksman puts the butt end against the shoulder. When the press plate is in its outer position the switch 15 is switched off. A prerequisite for the servo system motors to operate is that the main switch 14 is switched on and that the press plate 12 is pushed in and thereby the switch 15 is switched on. The press plate 12 and the switch 15 connected thereto thus have as their function to activate the servo system motors and stabilize the aiming direction only during aiming, i.e. when the rifle is held pressed against the shoulder, not else. In this way the consumption of current is decreased.

In the case of a handgun the press plate activating the servo system motors is replaced by a switch 7 mounted at a suitable position on the weapon where it can be operated by the marksman when he is aiming. In FIG. 2 a positioning has been specified which makes it possible for the shot to activate the servo system by pressing down a press button in the butt end rear end. The exact positioning of this switch 7 will be decided considering the weapon design and how it is held in the hand when aiming.

In handguns the available space in the weapon is not big enough to house a servo system and mechanics. For this reason but also to increase the butt end 2 moment of inertia these parts are suitably located under and behind the pistol grip. A possible design is shown in FIG. 2. The increase of the moment of inertia results in that a certain specified angle change between the butt end and the barrel may take place with a smaller rotation of the butt end.

Above the invention has been described in association with examples of design and preferred embodiments.

Of course further embodiments as well as minor changes and additions may be imagined without departing from the basic inventive idea.

The invention claimed is:

1. A method for stabilizing a weapon by attenuating the influence of unintentional barrel movements on the barrel orientation, said weapon comprising a front part and a rear part, the front part comprising a barrel, the rear part comprising a butt end, and a hinge between the barrel and butt end, said method comprising:

detecting the barrel movement in at least two planes;

controlling at least one angle between the butt end and longitudinal orientation of the barrel through a control system which counteracts changes in the barrel orientation; and mutually turning said front part and said rear part by means of operation means running from said hinge and being arranged at said front part and protruding into the butt end of said rear part for control by said control system.

2. The method according to claim 1, wherein the at least two planes comprise a first plane and a second plane, the first plane mutually perpendicular to the second plane and the first plane substantially vertical and the second plane substantially horizontal.

3. The method according to claim 1, wherein the control system comprises a vertical channel and a horizontal channel, said method further comprising:

detecting angular speed with reference to the barrel movement in the vertical and horizontal directions through the vertical and horizontal channels, respectively, and transmitting the angular speed from each of said channels.

4. A method according to claim 2, further comprising moving the hinge in each of the two planes.

5. A method according to claim 1, wherein said hinge comprises a cardan joint configuration.

6. A method according to claim 1, wherein said control system comprises a servo system, said method further comprising the servo system controlling the angle between the butt end and the barrel longitudinal direction orientation, respectively, in two mutually perpendicular planes.

7. A method according to claim 3, wherein each of the control system channels comprises an amplifier with a band pass filter which amplifies and filters the signal from the angular speed transmitter in the channel.

8. A method according to claim 7, further comprising:

filtering the signal from the angular speed transmitters in the amplifiers by a high pass filter and thereby suppressing signals having comparatively low frequency and letting signals having comparatively high frequency through, so that comparatively slow changes of the barrel orientation are not counteracted, attenuated, to as high a degree as fast changes of orientation.

9. A method according to claim 8, further comprising:

providing high pass filtering with a limiting frequency of the high pass filter for adaption of the attenuation of barrel movements.

10. A method according to claim 9, comprising:

providing the limiting frequency in the interval of about 0.5 to about 5 Hz.

11. A method according to claim 1, wherein the butt end comprises a drive means in each channel.

12. A method according to claim 11, wherein the drive means are electrical motors, said method further comprising:

driving the electrical motor in each channel of the control system to control the angle between the butt end and the barrel in each of the vertical and horizontal directions.

13. A method according to claim 12, comprising the motors affecting an operation element each to perform a reciprocating mainly linear movement.

14. A method according to claim 13, wherein two motors and said operation elements move the respective operation elements in two mutually perpendicular directions corresponding to the two channels.

15. A method according to claim 14, connecting said operation element with said operation means to mutually turn said front part and said rear part.

16. A method according to claim 15, wherein said operation element is applied to a portion, turned from the front part, of an operation means in the form of a rod element protruding into the butt end.

17. A method according to claim 1, further comprising:

activating the control system by means of switch devices arranged to be operated by an aiming person in association with aiming after a main switch for the control system current supply has been switched on.

18. A device for stabilizing a weapon by attenuating the influence of unintentional barrel movements, comprising:

a joint between a weapon front part, the weapon front part comprising a barrel, and a weapon rear part, the rear part comprising a weapon butt end, the joint configured to provide mutual movability between said front and rear parts;

devices for continuously detecting a barrel movement in at least two planes; and a control system configured to control at least one angle between the butt end and barrel longitudinal direction orientation, respectively, so that changes in the barrel orientation are opposed, wherein operation means are provided for mutually turning said front part and said rear part, said operation means running from said joint and being arranged at said front part and protruding into the butt end of said rear part for control by said control system.

19. A device according to claim 18, wherein the two mutually perpendicular planes comprise a substantially vertical and a substantially horizontal plane.

20. A device according to claim 18, wherein the control system comprises two channels, one channel per plane, where one channel is a vertical channel and the other is a horizontal channel, each channel comprising means for detection of angular speed, angular speed transmitters, referring to the barrel movement in the respective plane.

21. A device according to claim 18, characterized in that said joint is arranged for mutual movability of said parts in the two planes, in which the barrel movements are detected.

22. A device according to claim 18, wherein the joint comprises a cardan joint configuration.

23. A device according to claim 18, wherein said control system comprises a servo system for controlling the angle between the butt end and the barrel longitudinal direction orientation, respectively, in two mutually perpendicular planes.

24. A device according to claim 23, wherein each one of the two control system channels comprises an amplifier with a band pass filter, which amplifies and filters the signal from the angular speed transmitter in the channel.

25. A device according to claim 24, wherein the signal from the angular speed transmitters is arranged to be filtered in the amplifiers by a high pass filter and thereby suppress signals having a comparatively low frequency and let signals having a comparatively high frequency through, so that comparatively slow changes of the barrel orientation are not counteracted, attenuated, to as high a degree as fast, usually unintentional, changes of orientation.

26. A device according to claim 25, wherein the high pass filter is arranged with a limiting frequency for adaption of attenuation of barrel movements.

27. A device according to claim 26, characterized in that the high pass filter is arranged with a limiting frequency in the interval about 0.5 to about 5 Hz.

28. A device according to claim 18, comprising drive means in the butt end for controlling of said operation means.

29. A device according to claim 28, comprising drive means in the form of an electrical motor per channel of the control system for control of the angle between the butt end and the barrel in the vertical and horizontal direction, respectively.

30. A device according to claim 29, characterized in that the motors are arranged to affect an operation element by each performing a reciprocating linear motion.

31. A device according to claim 30, characterized in that the two motors and said operation elements are arranged to move the respective operation elements in two mutually perpendicular directions corresponding to the two channels.

32. A device according to claim 31, characterized in that said operation element is arranged to be connected to said operation means to mutually turn said front part and said rear part.

33. A device according to claim 32, characterized in that said operation element is applied to a portion, turned from the front part, of an operation means in the form of a rod element protruding into the butt end.

34. A device according to claim 18, characterized in that the control system is arranged to be activated by means of switch devices arranged to be operated by an aiming person in association with aiming after that a main switch for the control system current supply has been switched on.

35. A fire arm comprising the device of claim 18.

36. The fire arm according to claim 35, wherein the fire arm is a rifle.

* * * * *